US005806486A

United States Patent [19]

Gee et al.

[11] Patent Number: 5,806,486

[45] Date of Patent: Sep. 15, 1998

[54] AUTOMATIVE ENGINE IDLE SPEED CONTROL

[75] Inventors: Thomas Scott Gee, Canton; Borys Joseph Melnyk, Allen Park, both of Mich.

[73] Assignee: Ford Global Technologies, Inc., Dearborn, Mich.

[21] Appl. No.: 944,632

[22] Filed: Oct. 6, 1997

[51] Int. Cl.[6] ..... F02M 3/09

[52] U.S. Cl. ..... 123/339.22; 123/339.24

[58] Field of Search ..... 123/339.22, 339.24, 123/339.27, 142.5 R

[56] References Cited

U.S. PATENT DOCUMENTS

| | | | |
|---|---|---|---|
| 4,399,789 | 8/1983 | Yano | 123/339.22 |
| 4,434,760 | 3/1984 | Kobayashi et al. | 123/339.22 |
| 4,688,534 | 8/1987 | Takeda et al. | 123/339.24 |
| 4,716,871 | 1/1988 | Sakamoto et al. | 123/339.22 |
| 4,875,446 | 10/1989 | Nemoto et al. | 123/339.22 |
| 4,886,025 | 12/1989 | Bonfiglioli et al. | 123/339.22 |
| 5,605,128 | 2/1997 | Nusser et al. | 123/339.24 |
| 5,651,342 | 7/1997 | Hara | 123/339.24 |

FOREIGN PATENT DOCUMENTS

| | | | |
|---|---|---|---|
| 62-93465 | 4/1987 | Japan | 123/339.24 |
| 6-146959 | 5/1994 | Japan | 123/339.24 |
| 6-146972 | 5/1994 | Japan | 123/339.24 |

*Primary Examiner*—Erick R. Solis

[57] ABSTRACT

A system for controlling the idle speed of an automotive engine selects a desired initial idle speed based on a sensed value of at least one engine operating parameter and operates an idle speed module to maintain the engine's idle speed at the desired initial speed. Thereafter, the system determines a desired total heat build for the engine as a function of at least one engine operating parameter and adjusts the idle speed according to a calculated actual heat build for the engine while the engine is operating.

22 Claims, 2 Drawing Sheets

AUTOMATIVE ENGINE IDLE SPEED CONTROL

BACKGROUND OF THE INVENTION

1. Technical Field

The present invention relates to a system and method for controlling the idle speed of an automotive engine.

2. Disclosure Information

Engine idle speed control strategies employed following cold start-up of an engine have traditionally allowed the engine to run at a higher speed until the coolant attains a given temperature. Alternatively, engines have been operated either for a fixed time or perhaps even a variable time. One problem with prior schemes is that thermally based systems were unable to handle situations in which increased idle speed was desirable for cooling the engine following a hot restart. And, time based systems failed to account for such important warm-up factors as driving patterns and accessory operation. Following a hot restart, it is important to quickly establish a stable engine idle, and this is promoted by temporarily increasing the idle speed to cool the engine. Finally, previous idle control systems terminated the high cam function either abruptly or in steps. This too was undesirable because step changes in idle speed are potentially irritating to motorists.

The present invention uses an algorithm having at least one input from engine speed and load to control engine idle speed after cold start-up, thereby allowing more precise control of engine speed with the benefit that engine fuel economy will be increased while reducing needless exhaust emissions.

SUMMARY OF THE INVENTION

A system for controlling idle speed of an automotive engine, particularly following cold start-up, comprises a plurality of sensors for sensing values of engine operating parameters, including at least one temperature associated with operation of the engine, and also including sensors having outputs from which engine speed and load may be determined. An idle speed module controls the engine speed during idle operation; an engine controller, which receives inputs from the sensors, operates the idle speed module. The engine controller begins the control process by selecting a desired idle speed based on a sensed value of at least one engine operating parameter, which may, for example, comprise an engine coolant temperature. Then, while operating the idle speed module to maintain the engine's idle speed at the desired initial idle speed, the controller determines a desired total heat build for the engine as a function of at least one of the engine's operating parameters. These may include engine coolant temperature, the elapsed time since last operation of the engine, or other engine operating parameters known to those skilled in the art and suggested by this disclosure. Having selected a total heat build for the engine, the controller continues by periodically determining speed and load and by calculating actual heat build for the engine as a function of either the determined engine speed, or load, or both. The controller adjusts idle speed according to the relative values of the desired total heat build and the actual heat build. When the predetermined total heat build has been reached, the engine is operated at a predetermined base idle speed.

According to another aspect of the present invention, the engine controller selects a desired initial idle speed based at least in part upon the temperature of coolant circulating through the engine at the time engine is started. This desired initial engine speed may be based in part upon the amount of air which will flow past the outside surfaces of the engine when the engine is in operation, as well as upon the particular coolant flow characteristics of the engine. The former factor may be particularly significant because free air flowing on the engine's external surfaces may increase the amount of time required to warm the engine to a desired operating temperature. The controller tracks the actual heat build and reduces the idle speed from the initial idle speed to the base or curb idle speed as a function of the value of the actual heat build and the value of the desired total heat build. This may be a linear function or some other function known to the skilled in the art as suggested by this disclosure.

According to another aspect of the present invention, a method for controlling the idle speed of an automotive engine includes the steps of sensing values of a plurality of engine operating parameters including at least one temperature associated with operation of the engine and including sensed values from which engine speed and load may be determined, selecting a desired initial idle speed based on a sensed value of at least one engine operating parameter, operating in an idle speed module to maintain the engine's idle speed at the desired initial idle speed, determining a desired total heat build for the engine as a function of the sensed value of at least one of said engine operating parameters, determining engine speed and load, calculating actual heat build for the engine as a function of at least one of said determined engine speed and load parameters, and adjusting idle speed according to the relative values of the desired total heat build in the actual heat build.

DETAILED DESCRIPTION OF PREFERRED EMBODIMENTS

Figure 1:
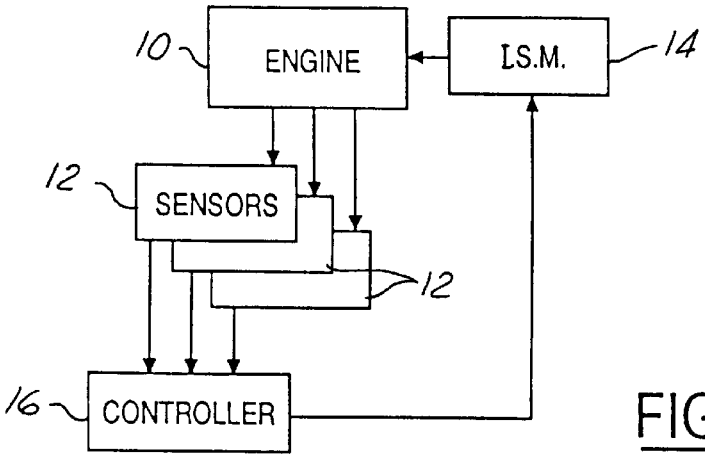
FIG. 1 is a schematic representation of an engine having a system for controlling idle speed according to the present invention.

As shown in FIG. 1, an automotive internal combustion engine has a plurality of sensors 12 which communicate with an engine controller 16. The sensors may include, without limitation, sensors for measuring engine speed, engine load, engine coolant temperature, and other parameters known to those skilled in the art and suggested by this disclosure. Controller 16, which receives inputs from sensors 12, operates idle speed module 14 to maintain the idle speed of engine 10 at a desired level. Idle speed module 14 may comprise either an idle air bypass solenoid, or an ignition timing control, or yet other types of devices known to those skilled in the art and suggested by this disclosure. For example, because a system according to the present invention could be used with a diesel engine, an ignition timing controller comprising idle speed module 14 could include a fuel injection pump having variable injection timing.

Controller 16 selects a desired engine speed based on the value of an engine operating parameter, such as coolant temperature. Those skilled in the art will appreciate in view of this disclosure other parametric values such as ambient temperature or air charge temperature could be used in the initial selection of desired initial idle speed.

Figure 2:
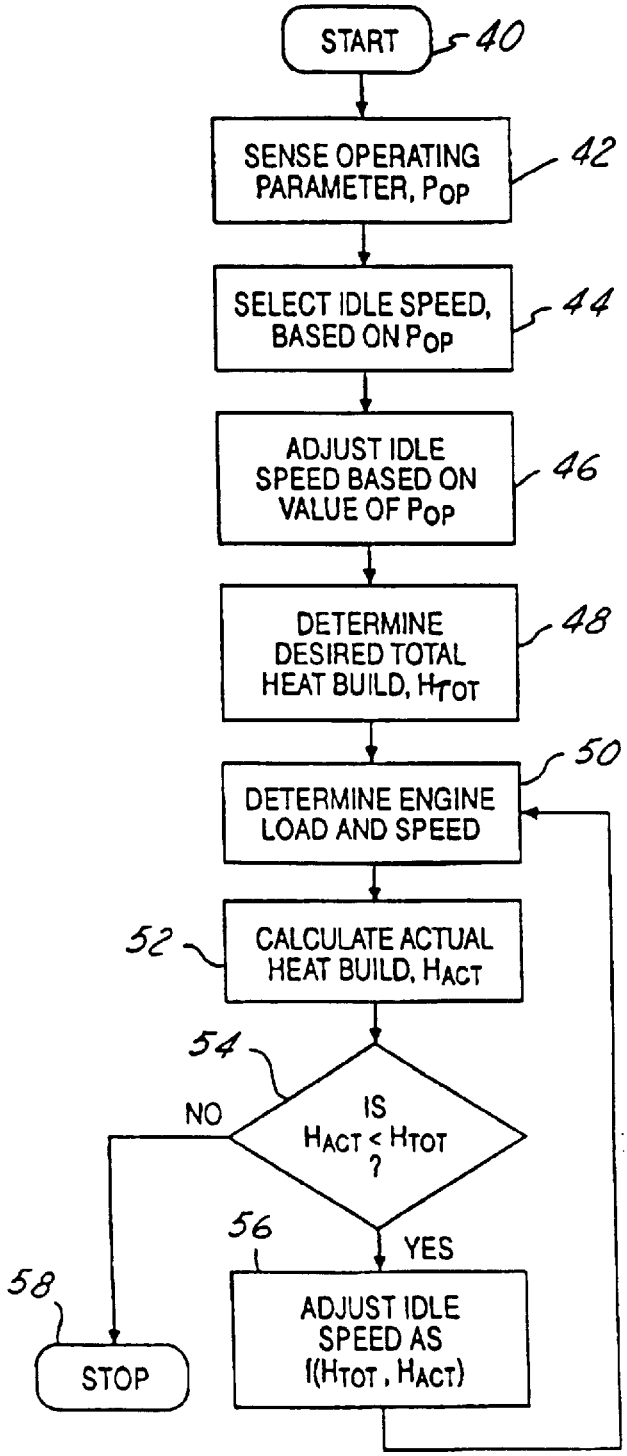
FIG. 2 is a flowchart illustrating operation of a system according to the present invention.

FIG. 2 illustrates a process for controlling engine idle speed according to the present invention. Controller 16, starting at block 40, senses an operating parameter, $P_{OP}$, and moving to block 44, controller 16 selects idle speed based on $P_{OP}$. Then, using idle speed module 14, the idle speed is adjusted at block 46. The idle speed can be adjusted at a varying frequency, which frequency may be selected according to the type of engine of vehicle having an idle control system according to the present invention. For example, with a vehicle having faster warm-up characteristics, which would be expected for a smaller engine, such as a three or four cylinder engine, the idle speed may be adjusted on a more frequent basis.

Having adjusted the idle speed of block 46, controller 16 moves to block 48 where the controller determines the desired total heat build, $H_{TOT}$. The value of $H_{TOT}$ may be drawn from a look-up table within the controller memory, or determined analytically. In either event, predetermined values for $H_{TOT}$, whether measured in BTU's or other units, may be determined empirically.

Figure 3:
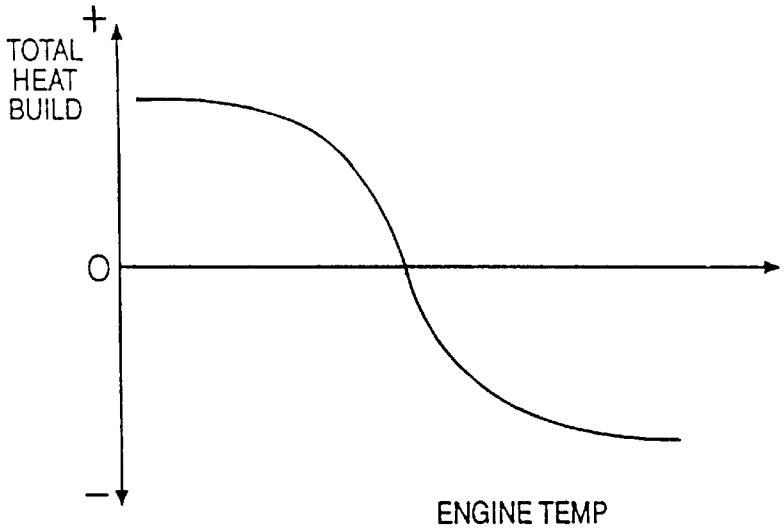
FIG. 3 illustrates heat build versus engine temperature according to one aspect of the present invention.

FIG. 3 illustrates an empirically determined heat build curve showing the desired total heat build as a function of engine operating temperature at start-up. The curve of FIG. 3 may of course be tailored by the user of a system according to the present invention to meet the particular needs of an engine installed in an automotive vehicle. For example, it is noted in FIG. 3 that as engine temperature increases, the heat build curve gradually decreases until, having passed below the abscissa, the heat build is shown as a negative value. This means that the present system may be used to cool the engine following a hot restart. This is accomplished by increasing the idle speed, so as to correspondingly increase the airflow pulled through the cooling radiator (not shown), as well as the flow rate of the coolant circulating through the engine and radiator. In sum, according to FIG. 3, the desired total heat build increases and then decreases to a negative value as initial engine temperature increases.

Having determined desired total heat build at block 48, controller 16 moves to block 50, wherein engine load and speed are determined. In general engine speed is measured directly by one of sensors 12, with engine load being calculated in a conventional fashion by comparing the instantaneous mass of air charge actually drawn into the engine over a predetermined time period with a predetermined maximum possible mass of air which could be drawn into the cylinders during the identical time period.

The periodically determined load and speed are used at block 52 to calculate actual heat build, $H_{ACT}$. The actual heat build is determined by taking an instantaneous heat build figure from a second look-up table, which includes, as its independent variables, engine load and speed. Alternatively, engine load or engine speed may be used as the sole variable for determining heat build. The periodically determined heat build drawn from the lookup table as a function of engine load and/or speed is added to a previously determined value of heat build at block 52, so as to get a summed total heat build for the period of operation under consideration. Having calculated the actual heat build at block 52, controller 16 moves to block 54 wherein the question is asked whether actual heat build $H_{ACT}$ is less than determined desired total heat build $H_{TOT}$. If the answer at block 54 is no, this means that the actual heat build is at least equal to the desired total heat build, and the routine is stopped at block 58. If the answer at block 54 is yes, the actual heat build is less than the total desired heat build and controller 16 moves to block 56, wherein the engine idle speed is adjusted as a function of $H_{TOT}$ and $H_{ACT}$. This adjustment at block 56, while clearly being a function of $H_{TOT}$ and $H_{ACT}$, may comprise a simple function of the quotient of $H_{ACT}$ divided by $H_{TOT}$, or a more complicated function.

Figure 4:
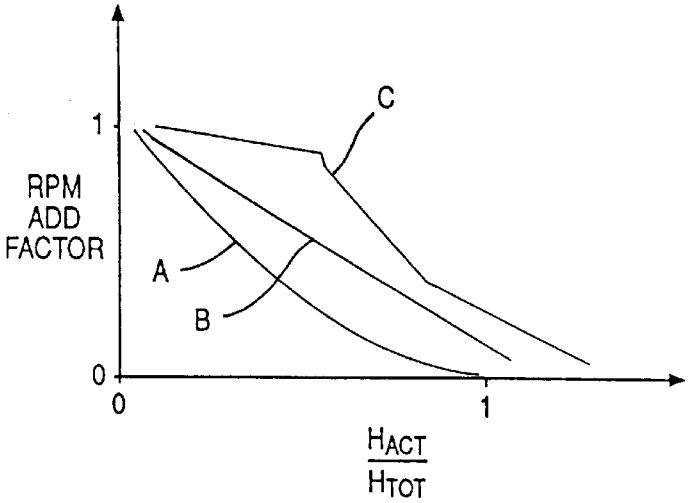
FIG. 4 illustrates an RPM adding function as a function of desired total heat build and measured actual heat build according to several strategies of the present invention.

FIG. 4 illustrates that a RPM addition factor which goes from one to zero in value, and which merely comprises a fraction of an initial idle speed increase which is applied to the base idle speed of the engine, may be either a linear function, as shown by curve B, or other nonlinear functions, as shown by curves A and C. In any event, having adjusted idle speed at block 56, controller 16 returns to block 50, wherein engine speed and load are determined once again. This determination is followed by the balance of the idle speed adjustment routine.

The initial idle speed adjustment based on the value of $P_{OP}$ at block 46, can be done as a function of an engine and vehicle factor. For example, if the vehicle is equipped with a manual transmission versus an automatic transmission, the choice could be different in terms of the idle speed increments. Also, driver preferences may be used as a control parameter. For example, if idle speed kickdown by the driver is sensed and recorded through the use of a throttle position sensor as one of sensors 12, the desired initial idle speed may be updated and the frequency of idle speed update may be adjusted accordingly. In other words, if the driver kicks down the idle speed by vigorously tapping the accelerator pedal after the engine is started so as to remove the throttle from its high cam or high speed position, controller 16, sensing the kickdown by means of a throttle position sensor comprising one of sensors 12, may adjust the idle speed to a lower value at block 46, and may update the idle speed on a more frequent basis. Those skilled in the art will appreciate that a software program used for operating a system according to the present invention may be adjusted to customize the idle updating process to accommodate the needs of any particular engine/vehicle/driver combination.

While the invention has been shown and described in its preferred embodiments, it will be clear to those skilled in the arts to which it pertains that many changes and modifications may be made thereto without departing from the scope of the invention.

We claim:

1. A system for controlling the idle speed of an automotive engine, comprising:

a plurality of sensors for sensing values of engine operating parameters, including at least one temperature associated with operation of the engine, and including sensors having outputs from which engine speed and load may be determined;

an idle speed module for controlling the engine's speed during idle operation; and an engine controller for receiving outputs from the sensors and for operating the idle speed module, with said engine controller:

selecting a desired initial idle speed based on a sensed value of at least one engine operating parameter;

operating the idle speed module to maintain the engine's idle speed at the desired initial idle speed;

determining a desired total heat build for the engine as a function of at least one of said engine operating parameters;

determining engine load;

calculating actual heat build for the engine as a function of the determined engine load; and adjusting the idle speed according to the relative values of the desired total heat build and the actual heat build.

2. A system according to claim 1, wherein said engine controller further determines instantaneous engine speed and calculates actual heat build for the engine as a function of the determined engine load and speed.

3. A system according to claim 1, wherein said engine controller selects a desired initial idle speed based at least in part upon the temperature of coolant circulating through the engine at the time the engine is started.

4. A system according to claim 1, wherein said engine controller selects a desired initial idle speed based at least in part upon the amount of air which will flow past the outside surfaces of the engine when the engine is in operation.

5. A system according to claim 1, wherein the desired initial idle speed is selected to be greater than a curb idle speed used for normal operation, with the idle speed being reduced from the initial idle speed to the curb idle speed as a function of the value of the actual heat build divided by the value of the desired total heat build.

6. A system according to claim 1, wherein the desired initial idle speed is selected to be greater than a curb idle speed used for normal operation, with the idle speed being reduced from the initial idle speed to the curb idle speed as a nonlinear function of the values of the actual heat build and the desired total heat build.

7. A system according to claim 1, wherein the desired initial idle speed is selected to be greater than a curb idle speed used for normal operation, with the idle speed being reduced from the initial idle speed to the curb idle speed as a linear function of the value of the actual heat build divided by the value of the desired total heat build.

8. A system according to claim 1, wherein said idle speed module comprises an air bypass solenoid for allowing air to pass into the engine.

9. A system according to claim 1, wherein said idle speed module comprises an ignition timing controller.

10. A system according to claim 1, wherein the desired initial idle speed is updated in the event that the controller senses kickdown of an accelerator pedal by a vehicle driver operating the engine.

11. A system according to claim 10, wherein the desired initial idle speed is decreased in the event that the controller senses kickdown of an accelerator pedal by a vehicle driver operating the engine.

12. A method for controlling the idle speed of an automotive engine, comprising the steps of:

sensing values of a plurality of engine operating parameters, including at least one temperature associated with operation of the engine and including sensed values from which engine speed and load may be determined;

selecting a desired initial idle speed based on a sensed value of at least one engine operating parameter;

operating an idle speed module to maintain the engine's idle speed at the desired initial idle speed;

determining a desired total heat build for the engine as a function of the sensed value of at least one of said engine operating parameters;

periodically determining engine speed and load;

calculating actual heat build for the engine as a function of determined engine speed and load; and adjusting the idle speed according to the relative values of the desired total heat build and the actual heat build.

13. A system according to claim 12, wherein the selection of said desired initial idle speed is based at least in part upon the temperature of coolant circulating through the engine at the time the engine is started.

14. A system according to claim 12, wherein the desired total heat build is determined according to initial engine temperature such that the desired total heat build increases and then decreases to a range of negative values as initial engine temperature increases.

15. A system according to claim 12, wherein the selection of said desired initial idle speed based at least in part upon an airflow coefficient related to the amount of air which will flow past the outside surfaces of the engine when the engine is in operation.

16. A system according to claim 12, wherein the desired initial idle speed is selected to be greater than a curb idle speed used for normal operation, with the idle speed being reduced from the initial idle speed to the curb idle speed as a function of the value of the actual heat build divided by the value of the desired total heat build.

17. A system according to claim 12, wherein the desired initial idle speed is selected to be greater than a curb idle speed used for normal operation, with the idle speed being reduced from the initial idle speed to the curb idle speed as a linear function of the value of the actual heat build divided by the value of the desired total heat build.

18. A system for controlling the idle speed of a reciprocating automotive internal combustion engine following a cold startup, comprising:

a plurality of sensors for sensing values of engine operating parameters, including engine coolant temperature, and including sensors having outputs from which engine speed and load may be determined;

an idle speed module for controlling the engine's speed during idle operation; and an engine controller for receiving outputs from the sensors and for operating the idle speed module, with said engine controller:

selecting a desired initial idle speed based on a sensed value of engine coolant temperature, with said desired initial idle speed being greater than a curb idle speed in the event that the sensed engine coolant temperature is less than a predetermined threshold;

operating the idle speed module to maintain the engine's idle speed at the desired initial idle speed;

determining a desired total heat build for the engine as a function of at least engine coolant temperature;

periodically determining engine speed and load;

calculating actual heat build for the engine as a function of the periodically determined engine speed and load; and adjusting the idle speed according to the relative values of the desired total heat build and the actual heat build.

19. A system according to claim 18, wherein said load is calculated by comparing the instantaneous mass of the air charge drawn into each cylinder with a predetermined maximum possible mass of air which could be drawn into each cylinder.

20. A system according to claim 19, wherein actual heat build is calculated by summing a series of successive heat build values, with each value being drawn from a table as a function of calculated load and engine speed.

21. A system according to claim 18, wherein said idle speed module comprises an air bypass solenoid for allowing air to pass into the engine.

22. A system according to claim 18, wherein said idle speed module comprises an ignition timing controller.

* * * * *